US005616189A

United States Patent [19]

Jin et al.

[11] Patent Number: 5,616,189

[45] Date of Patent: Apr. 1, 1997

[54] ALUMINUM ALLOYS AND PROCESS FOR MAKING ALUMINUM ALLOY SHEET

[75] Inventors: Iljoon Jin; John Fitzsimon, both of Kingston, Canada; Michael J. Bull, Brighton, Mich.; Pierre H. Marois, Kingston, Canada; Alok K. Gupta, Kingston, Canada; David J. Lloyd, Kingston, Canada

[73] Assignee: Alcan International Limited, Montreal, Canada

[21] Appl. No.: 279,214

[22] Filed: Jul. 22, 1994

Related U.S. Application Data

[63] Continuation-in-part of Ser. No. 97,840, Jul. 28, 1993, abandoned.

[51] Int. Cl.[6] ..... C22F 1/04

[52] U.S. Cl. ..... 148/549; 148/552; 148/693; 148/699; 148/700; 148/701; 148/702; 148/416; 148/417; 148/418; 148/438; 148/439; 148/440; 164/429; 164/476; 164/481; 420/532; 420/534; 420/535; 420/541; 420/544; 420/546; 420/548; 420/550; 420/551; 420/552; 420/553

[58] Field of Search ..... 148/549, 552, 148/693, 699, 700, 701, 702, 416, 417, 418, 438, 439, 440; 164/429, 476, 481; 420/532, 534, 535, 541, 544, 546, 548, 550, 551, 552, 553

[56] References Cited

U.S. PATENT DOCUMENTS

| | | | |
|---|---|---|---|
| 526,133 | 11/1993 | Uchida et al. | 148/552 |
| 2,790,216 | 4/1957 | Hunter | 222/591 |
| 3,945,861 | 3/1976 | Anderson et al. | 148/693 |
| 4,061,177 | 12/1977 | Sivilotti et al. | 164/87 |
| 4,061,178 | 12/1977 | Sivilotti et al. | 164/87 |
| 4,082,578 | 4/1978 | Evancho et al. | 148/693 |
| 4,174,232 | 11/1979 | Lenz et al. | 148/552 |

(List continued on next page.)

FOREIGN PATENT DOCUMENTS

| | | |
|---|---|---|
| 191586A | 8/1986 | European Pat. Off. . |
| 0282162 | 9/1988 | European Pat. Off. . |
| 0480402 | 4/1992 | European Pat. Off. . |
| 0576171A1 | 12/1993 | European Pat. Off. . |

(List continued on next page.)

OTHER PUBLICATIONS

Leone,et al., "Alcan Belt Casting Process–Mini–Mill Concept", pp. 579–624; Proceedings of Ingot and Continuous Casting Process Technology Seminar for Flat Rolled Products, vol. II; The Aluminum Association, New Orleans: May 10–12, 1989.

*Primary Examiner*—David A. Simmons
*Assistant Examiner*—Robert R. Koehler
*Attorney, Agent, or Firm*—Cooper & Dunham LLP

[57] ABSTRACT

An alloy of aluminum containing magnesium, silicon and optionally copper in amounts in percent by weight falling within one of the following ranges:

(1) $0.4 \leqq Mg \leqq 0.8$, $0.2 \leqq Si \leqq 0.5$, $0.3 \leqq Cu \leqq 3.5$;

(2) $0.8 \leqq Mg \leqq 1.4$, $0.2 \leqq Si \leqq 0.5$, $Cu \leqq 2.5$; and (3) $0.4 \leqq Mg \leqq 1.0$, $0.2 \leqq Si \leqq 1.4$, $Cu \leqq 2.0$; said alloy having been formed into a sheet having properties suitable for automotive applications. The alloy may also contain at least one additional element selected from the group consisting of Fe in an amount of 0.4 percent by weight or less, Mn in an amount of 0.4 percent by weight or less, Zn in an amount of 0.3 percent by weight or less and a small amount of at least one other element, such as Cr, Ti, Zr and V. The alloy may be fabricated into sheet material suitable for automotive panels by, in a belt casting machine, producing alloy sheet by casting the alloy while extracting heat from the alloy at a rate that avoids both shell distortion of the sheet and excessive surface segregation, at least until said alloy freezes; solution heat treating the sheet to re-dissolve precipitated particles; and cooling the sheet at a rate that produces a T4 temper and a potential T8X temper suitable for automotive panels. By such means, panels suitable for automotive use can be produced efficiently and economically.

29 Claims, 3 Drawing Sheets

U.S. PATENT DOCUMENTS

| | | | |
|---|---|---|---|
| 4,238,248 | 12/1980 | Gyongyos et al. | 148/551 |
| 4,318,755 | 3/1982 | Jeffrey et al. | 148/439 |
| 4,424,084 | 1/1984 | Chisholm | 148/417 |
| 4,525,326 | 6/1985 | Schwellinger et al. | 420/535 |
| 4,589,932 | 5/1986 | Park | 148/693 |
| 4,614,224 | 9/1986 | Jeffrey et al. | 164/476 |
| 4,637,842 | 1/1987 | Jeffrey et al. | 148/417 |
| 4,784,921 | 11/1988 | Hyland et al. | 428/654 |
| 5,266,130 | 11/1993 | Uchida et al. | 148/552 |

FOREIGN PATENT DOCUMENTS

| | | |
|---|---|---|
| 0576170A1 | 12/1993 | European Pat. Off. . |
| 0583867 | 2/1994 | European Pat. Off. . |
| 2307599 | 11/1976 | France . |
| 22D1106 | 6/1985 | Germany . |
| 5112839 | 5/1993 | Japan . |
| 5125506 | 5/1993 | Japan . |
| 5263203 | 10/1993 | Japan . |
| 5306440 | 11/1993 | Japan . |
| 6145929 | 5/1994 | Japan . |
| 2172303 | 9/1986 | United Kingdom . |
| WO9518244 | 7/1995 | WIPO . |

ALUMINUM ALLOYS AND PROCESS FOR MAKING ALUMINUM ALLOY SHEET

CROSS-REFERENCE TO RELATED APPLICATION

This application is a continuation-in-part of prior patent application Ser. No. 08/097,840 filed Jul. 28, 1993 now abandoned.

FIELD OF THE INVENTION

This invention relates to aluminum alloys and to continuous processes for making sheet material from aluminum alloys useful, in particular, for automotive applications. More particularly, the invention relates to alloys of Al—Mg—Cu—Si and Al—Mg—Si and to processes applicable to such alloys.

BACKGROUND OF THE INVENTION

The automotive industry, in order to reduce the weight of automobiles, has increasingly substituted aluminum alloy panels for steel panels. Lighter weight panels, of course, help to reduce automobile weight, which reduces fuel consumption, but the introduction of aluminum alloy panels creates its own set of needs. To be useful in automobile applications, an aluminum alloy sheet product must possess good forming characteristics in the as-received T4 temper condition, so that it may be bent or shaped as desired without cracking, tearing or wrinkling. At the same time, the alloy panel, after painting and baking, must have sufficient strength to resist dents and withstand other impacts.

Several aluminum alloys of the AA (Aluminum Association) 2000 and 6000 series are usually considered for automotive panel applications. The AA6000 series alloys contain magnesium and silicon, both with and without copper but, depending upon the Cu content, may be classified as AA2000 series alloys. These alloys are formable in the T4 temper condition and become stronger after painting and baking. Because thinner and therefore lighter panels are required, significant increases in strength after painting and baking will be needed to meet these requirements.

In addition, known processes for making sheet material suitable for automotive panels from the alloys has involved a rather complex and expensive procedure generally involving semi-continuous direct chill (DC) casting of the molten alloy to form an ingot, scalping of the ingot by about ¼ inch per rolling face to improve the surface quality, homogenizing the alloy at a temperature between 500° to 580° C. for time periods between 1 to 48 hours and hot and cold rolling to the desired gauge. The rolled material may then be given a solution heat treatment at 500° to 575° C. for 5 minutes or less in a continuous heat treatment line, rapidly quenched and naturally aged for 48 hours or more. In this procedure, the scalping and homogenizing steps are particularly troublesome. Moreover, the homogenizing step prevents the sheet from being produced essentially continuously from the casting step to the re-roll step following hot rolling.

There is therefore a need for improved alloys and for improved processes for fabricating sheet material from such alloys.

SUMMARY OF THE INVENTION

An object of the present invention is to provide new alloys that facilitate procedures for making alloy sheet material useful, among other purposes, for automotive applications.

Another object of the invention is to provide aluminum alloys that can be made into strip by a belt casting procedure, for subsequent conversion to sheet material suitable, in particular, for automotive applications.

Another object of the invention is to provide such an improved procedure for producing alloy sheet material that avoids the need for scalping of the cast ingot and homogenizing of the alloy.

Another object of the-invention is to provide an alloy product demonstrating improved strength after a paint bake cure.

Another object of the invention is to improve quenching methods to yield stronger aluminum alloys produced by belt casting or other means without sacrificing formability.

Other objects and advantages of the invention will become apparent from the following description.

According to one aspect of the invention, there is provided an alloy of aluminum containing magnesium, silicon and optionally copper in amounts in percent by weight falling within a range selected from the group consisting of:

(1) $0.4 \leqq Mg \leqq 0.8$, $0.2 \leqq Si \leqq 0.5$, $0.3 \leqq Cu \leqq 3.5$;

(2) $0.8 \leqq Mg \leqq 1.4$, $0.2 \leqq Si \leqq 0.5$, $Cu \leqq 2.5$; and (3) $0.4 \leqq Mg \leqq 1.0$, $0.2 \leqq Si \leqq 1.4$, $Cu \leqq 2.0$ wherein the alloy has been produced in the form of a sheet by a twin belt casting process and a hot and cold rolling process, said twin belt casting process having been carried out with a heat extraction rate within the range defined by the following equations:

Lower bound heat flux $(MW/m^2)=2.25+0.0183\ \Delta T_f$

Upper bound heat flux $(MW/m^2)=2.86+0.0222\ \Delta T_f$

Lower bound of alloy freezing range=30° C.

Upper bound of alloy freezing range=90° C.

where $\Delta T_f$ is given in degree Celsius.

The alloys may also contain at least one additional element selected from Fe in an amount of 0.4 percent by weight or less, Mn in an amount of 0.4 percent by weight or less, Zn in an amount of 0.3 percent by weight or less, and a small amount of at least one other element, e.g. Cr, Ti, Zr or V, the total amount of Cr+Ti+Zr+V not exceeding 0.3 percent by weight of the alloy.

According to another aspect of the invention, there is provided,a process of preparing aluminum alloy sheet material suitable in particular for automotive applications, comprising: in a twin-belt casting machine, producing alloy strip by casting an alloy of aluminum containing magnesium, silicon and optionally copper in amounts in percent by weight falling within a range selected from the group consisting of:

(1) $0.4 \leqq Mg \leqq 0.8$, $0.2 \leqq Si \leqq 0.5$, $0.3 \leqq Cu \leqq 3.5$ (2) $0.8 \leqq Mg \leqq 1.4$, $0.2 \leqq Si \leqq 0.5$, $Cu \leqq 2.5$, and (3) $0.4 \leqq Mg \leqq 1.0$, $0.2 \leqq Si \leqq 1.4$, $Cu \leqq 2.0$ while extracting heat from said alloy at a rate that avoids both shell distortion of said strip and excessive surface segregation, at least until said alloy freezes; hot and cold rolling said strip to sheet; solution heat treating said sheet to re-dissolve precipitated particles and to reduce the alloying element segregation that occurs during solidification; and cooling said sheet at a rate that produces T4 temper properties and potential T8X temper properties suitable for use in automotive applications.

According to yet another aspect of the invention, there is provided a process of imparting T4 and potential T8X temper properties suitable for automotive applications to a sheet of an aluminum alloy, comprising: solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, and then cooling to ambient temperature at a rate of less than about 10° C./hour; wherein said aluminum alloy contains magnesium, silicon and optionally copper in amounts in percent by weight falling within a range selected from the group consisting of:

(1) $0.4 \leqq Mg \leqq 0.8$, $0.2 \leqq Si \leqq 0.5$, $0.3 \leqq Cu \leqq 3.5$;

(2) $0.8 \leqq Mg \leqq 1.4$, $0.2 \leqq Si \leqq 0.5$, $Cu \leqq 2.5$; and (3) $0.4 \leqq Mg \leqq 1.0$, $0.2 \leqq Si \leqq 1.4$, $Cu \leqq 2.0$.

In this latter aspect of the invention, the alloy sheet may either be produced by belt casting followed by hot and cold rolling, as in other aspects of the invention, or by conventional means such as direct chill casting followed by scalping, homogenization, hot and cold rolling.

According to another aspect of the invention, there is provided a process of preparing aluminum alloy sheet material suitable in particular for automotive applications, comprising: in a belt casting machine, producing alloy slab by casting an alloy of aluminum containing magnesium, silicon and optionally copper in amounts in percent by weight falling within a range selected from the group consisting of:

(1) $0.4 \leqq Mg \leqq 0.8$, $0.2 \leqq Si \leqq 0.5$, $0.3 \leqq Cu \leqq 3.5$ (2) $0.8 \leqq Mg \leqq 1.4$, $0.2 \leqq Si \leqq 0.5$, $Cu \leqq 2.5$, and (3) $0.4 \leqq Mg \leqq 1.0$, $0.2 \leqq Si \leqq 1.4$, $Cu \leqq 2.0$ while extracting heat from said alloy at a rate that avoids both shell distortion of said sheet and excessive surface segregation, at least until said alloy freezes; hot rolling and cold rolling said slab to form a sheet; solution heat treating said sheet to re-dissolve precipitated particles; and cooling said sheet at a rate that produces a T4 temper and a potential T8X temper suitable for automotive applications.

According to yet another aspect of the invention, there is provided a process of imparting T4 and potential T8X temper properties suitable for automotive applications to a sheet of an aluminum alloy, comprising: solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, coiling said sheet and then cooling to ambient temperature at a rate of less than about 10° C./hour; wherein said aluminum alloy contains magnesium, silicon and optionally copper in amounts in percent by weight falling within a range selected from the group consisting of:

(1) $0.4 \leqq Mg \leqq 0.8$, $0.2 \leqq Si \leqq 0.5$, $0.3 \leqq Cu \leqq 3.5$;

(2) $0.8 \leqq Mg \leqq 1.4$, $0.2 \leqq Si \leqq 0.5$, $Cu \leqq 2.5$; and (3) $0.4 \leqq Mg \leqq 1.0$, $0.2 \leqq Si \leqq 1.4$, $Cu \leqq 2.0$.

According to yet another aspect of the invention, there is provided a process of imparting T4 and potential T8X temper properties suitable for automotive applications to a sheet of an aluminum alloy, comprising: solution heat treating said sheet at a temperature in the range of 500° to 570° C. and then forced cooling said sheet using a means of cooling selected from water, water mist or forced air, and coiling said sheet at a temperature of between 50° and 100° C., then allowing said coil to cool at a rate of less than about 10° C./hour; wherein said aluminum alloy contains magnesium, silicon and optionally copper in amounts in percent by weight falling within a range selected from the group consisting of:

(1) $0.4 \leqq Mg \leqq 0.8$, $0.2 \leqq Si \leqq 0.5$, $0.3 \leqq Cu \leqq 3.5$;

(2) $0.8 \leqq Mg \leqq 1.4$, $0.2 \leqq Si \leqq 0.5$, $Cu \leqq 2.5$; and (3) $0.4 \leqq Mg \leqq 1.0$, $0.2 \leqq Si \leqq 1.4$, $Cu \leqq 2.0$.

In the aspect of the invention defined immediately above, the sheet preferably exits the forced cooling at a temperature of between 120° and 150° C. and the sheet is preferably coiled at a temperature of at least 85° C. The cooling steps which follow the solution heat treatment of this invention may be referred to as a controlled quench process.

According to yet another aspect of the invention there is provided a process of preparing aluminum alloy sheet material suitable in particular for automotive panels, comprising: in a belt casting machine, producing alloy slab by casting an alloy of aluminum containing magnesium, silicon and optionally copper and having a solid solubility range of 20° C. or more while extracting heat from said alloy at a rate that avoids both shell distortion of said sheet and excessive surface segregation, at least until said alloy freezes; hot rolling and cold rolling said slab to form a sheet; solution heat treating said sheet to re-dissolve precipitated particles; and cooling said sheet at a rate that produces a T4 temper and a T8X temperature suitable for automotive panels.

The invention also relates to novel alloys and sheet material suitable for automotive applications suitable for or produced by the processes of the invention.

Reference is made in this disclosure to metal tempers T4 and T8X. The temper referred to as T4 is well known (see for example Aluminum Standards and Data (1984), page 11, published by The Aluminum Association). The alloys of this invention continue to change tensile properties after the heat treatment process and are generally processed through a flattening or levelling process before use. The T4 properties referred to therefore pertain to sheet which has been naturally aged for at least 48 hours after the heat treatment of this invention, and has subsequently been processed through a tension levelling process. This is in keeping with normal commercial practice for this type of alloy. The temper T8X may be less well known and it refers to a T4 temper material that has been deformed in tension by 2% followed by a 20 minute treatment at 170° C. or a 30 minute treatment at 177° C. to represent the forming plus paint curing treatment typically experienced by automotive panels. Potential T8X temper properties refer to the properties that the material of the given composition, subject to the processing step and thermal treatment will develop in a future process, such as a paint-bake step, that is equivalent to the T8X temper.

The above composition limits have been set first by the need to reach the tensile and formability property targets as set out in Table 1 below and, second, by the need to avoid the formation of second phase constituent particles from the primary alloying additions which will not be redissolved on solution heat treatment and which, therefore, do not add to the strength of the material but which, at the same time, will be detrimental to the formability. Thirdly, the composition limits have been set to ensure that the minimum solid solubility temperature range for the major alloying additions is at least 20° C. and preferably greater than 40° C. to ensure that the material can be effectively solution heat treated in a continuous strip line without approaching the temperature at which liquation and ensuing strip breaks would occur.

When the above alloys are produced by belt casting, it is a particular and surprising feature of the invention that it is possible to obtain automotive sheet with the desired T4 and potential T8X properties without the need for homogenization and scalping. It has been discovered that this occurs only if the belt casting is carried out for a specific heat flux extracted by the belts, which is related to the alloy freezing range ($\Delta T_f$), by the requirement that the heat flux lie in the area of heat flux versus alloy freezing range bounded by the following equations:

$$\text{Lower bound heat flux (MW/m}^2\text{)}=2.25+0.0183\ \Delta T_f$$

$$\text{Upper bound heat flux (MW/m}^2\text{)}=2.86+0.0222\ \Delta T_f$$

$$\text{Lower bound of alloy freezing range}=30°\ \text{C.}$$

$$\text{Upper bound of alloy freezing range}=90°\ \text{C.}$$

where $\Delta T_f$ is given in degree Celsius.

DETAILED DESCRIPTION OF THE PREFERRED EMBODIMENTS

While the alloys of the present invention can be used for other purposes (e.g. canning, building sheet materials, etc.), they are intended primarily as alloys for automotive applications, e.g. panels and skins. As such, they should desirably have a relatively low T4 strength (e.g. in the range of 90 to 175 MPa) to allow for easy part forming by automobile manufacturers, but a relatively high eventual T8X strength (e.g. 170 MPa or more) developed as a result of a typical automotive painting and baking procedure, in order to provide high resistance to denting. Other properties, such as good corrosion resistance, good surface quality, etc., are also clearly desirable. These desirable properties and others are shown in Table 1 below:

TABLE 1

| Property | Values |
|---|---|
| Yield Strength, T4[1] | 90–175 MPa |
| Yield Strength, T8X[2] | ≧170 MPa |
| Total Elongation, % | ≧25 |
| Erichsen Cup Height (inches) | ≧0.33 |
| Bend Radius to Sheet Thickness Ratio, r/t | ≦1 |
| Plastic Anisotropy, R | ≧0.60 |

[1]T4 refers to a condition where the alloy has been solution heat treated and naturally aged for ≧48 hours and subject to a flattening or levelling process.
[2]T8X refers to a condition where T4 material has been stretched by 2% and given an artificial aging at 170° C. for 20 minutes or 177° C. for 30 minutes.

According to a first aspect of the present invention, it has been found that certain Al—Cu—Mg—Si and Al—Mg—Si alloys of the AA2000 and AA6000 series can not only be fabricated into sheet material having many of the desired characteristics mentioned above, but surprisingly they can be cast by a procedure involving belt casting, such as twin belt casting, without the need for subsequent scalping of the resulting ingot surface and homogenizing of the product. This means that the fabrication of sheet material suitable for automotive applications can be made essentially continuously from caster to re-roll thus facilitating the manufacturing process.

Figure 1:
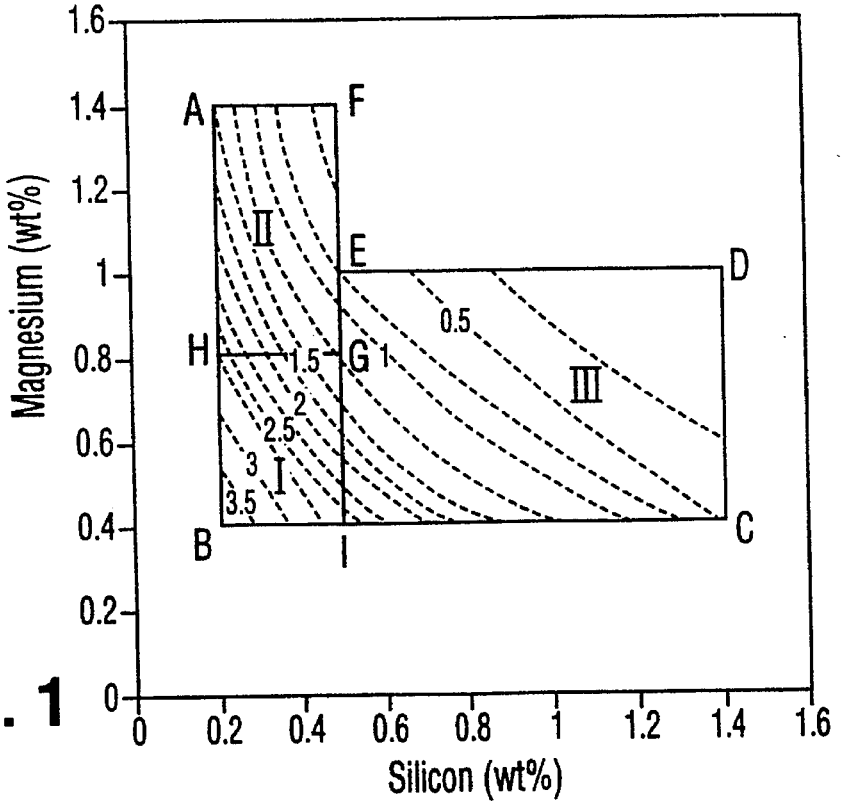
FIG. 1 is a chart showing Mg, Si and optionally Cu contents of aluminum alloys according to the present invention.

The aluminum alloys which have this advantage are those having compositions falling within the indicated volume on the chart of FIG. 1. This volume is defined by boundaries ABCDEF, which circumscribe the permitted silicon and magnesium contents of the alloys, upper contours 10 (shown in broken lines) within the boundaries ABCDEF, which specify the maximum copper contents of the alloys having particular magnesium and silicon contents, and lower surfaces (not shown) within the boundaries ABCDEF specifying the minimum copper content of the alloys at particular magnesium and silicon contents. The lower surface is at a copper content of 0.3 wt. % in Region I (BHGI), at a copper content of 0 wt. % in Region II (HAFG) and a copper content of 0 wt. % in Region III.

Thus, the effective alloys falling within the defined volume are those having approximately the following Mg, Si and Cu contents in wt. % of the total alloy:

(1) 0.4≦Mg≦0.8, 0.2≦Si≦0.5, 0.3≦Cu≦3.5 (Region I)

(2) 0.8≦Mg≦1.4, 0.2≦Si≦0.5, Cu≦2.5 (Region II)

(3) 0.4≦Mg≦1.0, 0.2≦Si≦1.4, Cu≦2.0 (Region III).

In addition, the alloys may optionally contain Fe≦0.4 wt. %, Mn≦0.4 wt. %, along with small amounts of other elements (e.g. Cr, Ti, Zr and V, such that the total amount of Cr+Ti+Zr+V does not exceed 0.3 wt. %). The balance of the alloys is aluminum and usual or unavoidable impurities.

These alloys may also be cast from recycled metal in which case zinc may be found as an impurity because of the pre-treatment applied to the original metal sheet. However, the sheet can still meet all requirements for levels of zinc where Zn≦0.3 wt%.

These alloys generally have freezing ranges of 30° to 90° C., which allows them to be belt cast to obtain acceptable surface characteristics and yet at the same time to avoid a significant amount of internal and surface segregation and second phase formation. These properties and T4 and T8X properties needed for automotive sheet require, however, that the belt casting process be carried out within the band of heat fluxes shown in FIG. 3. Moreover, the alloys have a solid solubility range of at least about 20° C. and more preferably at least about 40° C. This means that significant amounts of Mg, Si and, if present, Cu can be brought into solid solution through a solution heat treatment, rather than forming small range compositional variation type particles. This allows the sheet material to be successfully processed in a typical commercial continuous heat treatment line without causing breaks or the need for conventional homogenization.

Figure 2:
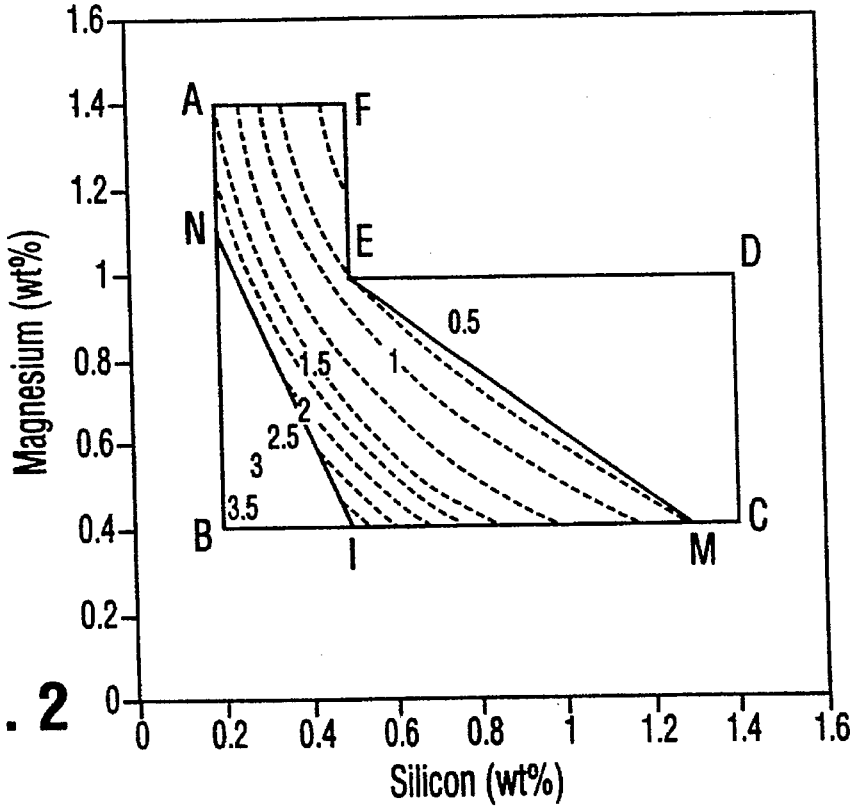
FIG. 2 is a chart similar to FIG. 1 showing the composition of preferred alloys.

The compositions of preferred alloys are shown in FIG. 2 in the volume bounded by shaded portion INAFEM. In this volume, the upper and lower limits for the Cu content are 0≦Cu≦2.5. The alloys having compositions within this volume have the best casting characteristics and optimal final properties.

This area is bounded by the following equations:

Mg=0.4% (Line *IM*)

Mg=1.375% −0.75×%Si (Line *EM*)

Si=0.5% (Line *EF*)

Mg=1.4% (Line *AF*)

Si=0.2% (Line *AN*)

Mg=1.567%−2.333×%Si (Line *IN*)

The alloys defined in FIGS. 1 and 2 may be subjected to belt casting using any conventional belt casting device, e.g. the twin belt caster described in U.S. Pat. No. 4,061,177 to Sivilotti, the disclosure of which is incorporated herein by reference. However, the casting may alternatively be carried out using a twin belt caster and casting procedure as disclosed in co-pending U.S. patent application Ser. No. 08/278,849 filed Jul. 22, 1994 entitled "PROCESS AND APPARATUS FOR CASTING METAL STRIP, AND INJECTOR USED THEREFOR", the disclosure of which is also incorporated herein by reference. This device and procedure employs a liquid parting agent (e.g. a mixture of natural and synthetic oils) applied in a thin uniform layer (e.g 20 to 500 μg/cm$^2$) by a precise method (e.g. by using electrostatic spray devices) onto a casting surface of a rotating metal belt prior to casting the molten metal onto the belt, followed by completely removing the parting agent from the casting surface after the casting step and re-applying a fresh parting agent layer before the belt rotates once again to the casting injector. The apparatus also employs a flexible injector held separate from the casting surface by wire mesh spacers which distribute the weight of the injector onto the casting surface without damaging the surface or disturbing the layer of liquid parting agent. The device and procedure make it possible to cast a thin strip of metal on a rotating belt and to obtain a product having extremely good surface properties, which is valuable in the present invention.

Whichever type of belt casting procedure is employed, it is important to ensure that heat is extracted from the molten metal at a certain rate during the casting process. If the rate of heat extraction is too low, surface blebs or segregates develop that give rise to unacceptable surface finish. Further, excessive segregation and second phase formation occur within the cast strip such that these cannot be eliminated by subsequent solution treatment within a reasonable combination of time and temperature. On the other hand, when the heat extraction rate is too high, surface distortion may occur during the freezing process. This locally disrupts the heat extraction and hence the freezing process, resulting in regions of coarse second phase particles, porosity and, in severe cases, cracking.

Figure 3:
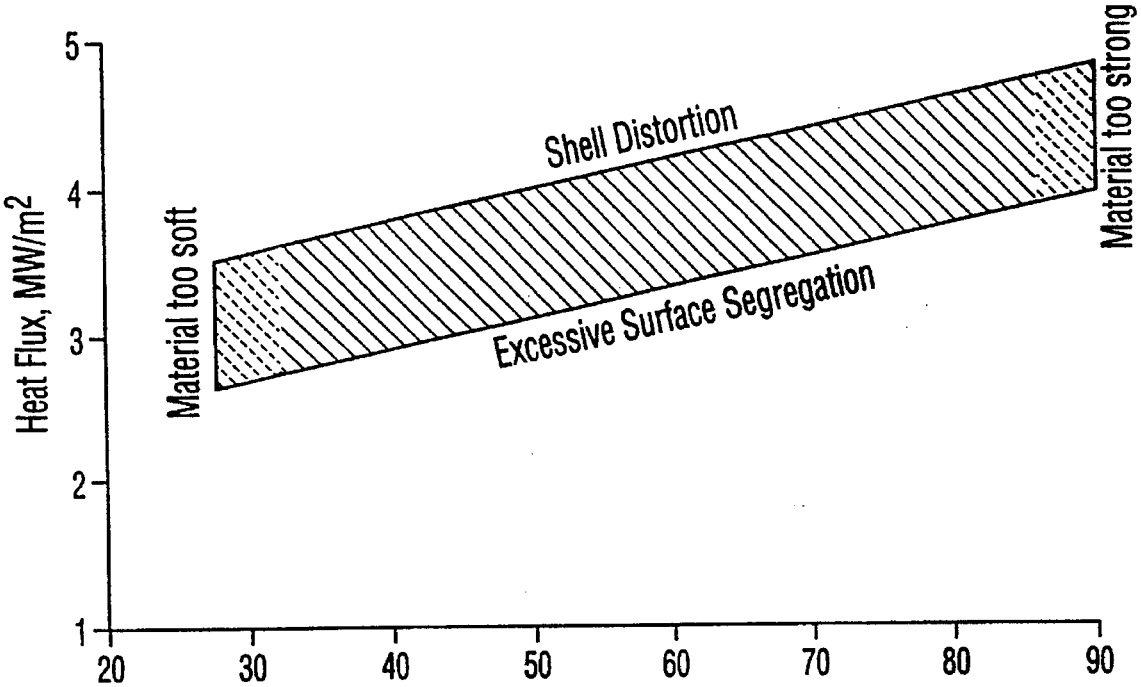
FIG. 3 is a chart showing acceptable heat extraction rates for alloys according to the invention of various freezing ranges.

It has been found that the above phenomena are correlated to a combination of the freezing range of the alloy being cast, which is dependent upon the composition of the alloy, and the rate of heat extraction (that is, the heat flux through the belts used to contain the cast metal during solidification). The relationship between freezing range and heat extraction rate is shown in FIG. 3, the acceptable heat extraction rates being shown in the shaded band of the graph.

Material to the left of the band is too soft, while the material to the right is too strong, and may exhibit large intermetallic and eutectic segregate formation. The solid solubility range for the material to the right of the band is also too short. Material above the band shows shell distortion, while material below the band shows excessive surface segregation.

The shaded band may be described as the area bounded by the following equations:

Lower bound heat flux (MW/m$^2$)=2.25+0.0183 $\Delta T_f$

Upper bound heat flux (MW/m$^2$)=2.86+0.0222 $\Delta T_f$

Lower bound of alloy freezing range=30° C.

Upper bound of alloy freezing range=90° C.

where $\Delta T_f$ is given in degree Celsius.

It is therefore preferable to employ controllable means in the belt caster for extracting heat from the metal being cast so that the rate of heat extraction for a particular alloy falls within the acceptable range. Such cooling is controlled by the belt material and texture and the thickness of a parting layer applied.

Following the casting process, the thin metal strip thereby produced is normally hot and cold rolled using conventional rolling equipment to achieve the final desired gauge required by the application.

At this stage, at least some of the alloys falling within the definition of FIG. 1 may be subjected to a conventional solution heat treatment and cooling to yield an Al-alloy sheet in appropriate T4 temper properties and with suitable eventual T8X temper properties. This would involve solution heat treating the cold rolled material at about 560° C. in a continuous annealing and solution heat treat (CASH) line, rapidly quenching the alloy to near ambient temperature, either in forced air or water, and then naturally aging the alloy for two days or more. However, in order to obtain a desirable T4 temper properties and eventually T8X type temper properties after forming, painting and baking, it is highly desirable that at least some of the alloys having the compositions falling within the definition of FIG. 1 should be subjected to a special procedure involving solution heat treatment followed by an improved continuous controlled cooling process, as explained below.

The solution heat treatment, by means of which precipitated alloying ingredients are re-dissolved in the alloy, generally involves heating the alloy sheet material to a temperature of between about 500° C. and about 570° C. (preferably about 560° C). The improved quenching or cooling process is then carried out. This involves cooling the alloy from the solution heat treatment temperature to an intermediate temperature without interruption and, without further interruption, cooling the aluminum alloy further to ambient temperature at a significantly slower rate. The intermediate target temperature may be approached in a single step of multiple steps.

A preferred quenching process involves four uninterrupted cooling phases or sequences: first, from the solution heat treatment temperature to a temperature between about 350° C. and about 220° C. at a rate faster than 10° C./sec, but no more than 2000° C./sec.; second, the alloy sheet is cooled from about 350° C. to about 220° C. to between about 270° C. and about 140° C. at a rate greater than about 1° C. but less than about 50° C./second; third, further cooling to between about 120° C. and about 50° C. at a rate greater than 5° C./min. but less than 20° C./sec; and fourth, from between about 120° C. and about 50° C. to ambient temperature at a rate less than about 10° C./hr.

The above quenching process may be carried out with an additional step of coiling the sheet before the final step of cooling the sheet to ambient temperature at a rate less than 10° C./hour.

Alternatively, the quenching process may involve forced cooling the sheet by means of water cooling, water mist cooling or forced air cooling, and coiling the sheet at a temperature of 50° to 100° C., then allowing the coil to cool at a rate of less than about 10° C./hour. The sheet most preferably exits the forced cooling at a temperature of between 120° to 150° C. and the sheet is preferably coiled at a temperature of at least 85° C.

Figure 4:
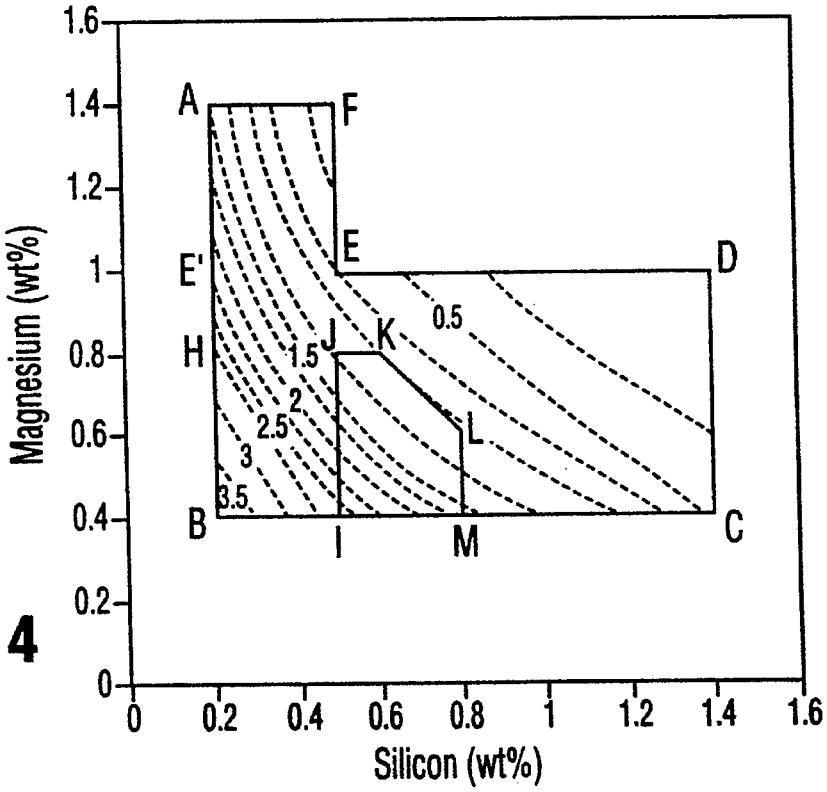
FIG. 4 is a chart similar to that of FIG. 1 showing alloy compositions for which a special quenching procedure is particularly preferred.

The alloys for which one of the above special quenching procedures is highly desirable, in order to develop acceptable final properties, are those falling within the area IJKLM of the chart of FIG. 4. The area IJKLM can be approximately defined as the area contained within the following equations:

Si=0.5% (Line *IJ*)

Mg=0.8% (Line *JK*)

Mg=1.4%−%Si (Line *KL*)

Si=0.8% (Line *LM*)

Mg=0.4% (Line *IM*)

and has Cu≦2.5%

In fact, for dilute alloys within the area IJKLM where Cu+Mg+Si≦1.4 wt. %, the controlled quenching procedure may be essential to meet target properties for use in automotive panels. For alloys having compositions outside the volume IJKLM of FIG. 4, but otherwise within the area ABCDEF of FIG. 1, one of the special procedures is optional but desirable because improved characteristics are thereby obtained.

Alloy sheets prepared by the process of the invention exhibit good storage qualities, that is to say, no significant age hardening of the alloys occur during storage at ambient temperature, and they develop high yield strength by age hardening during the paint bake cycle (or a heat treatment cycle emulating the paint bake cycle for unpainted metal parts).

Figure 5:
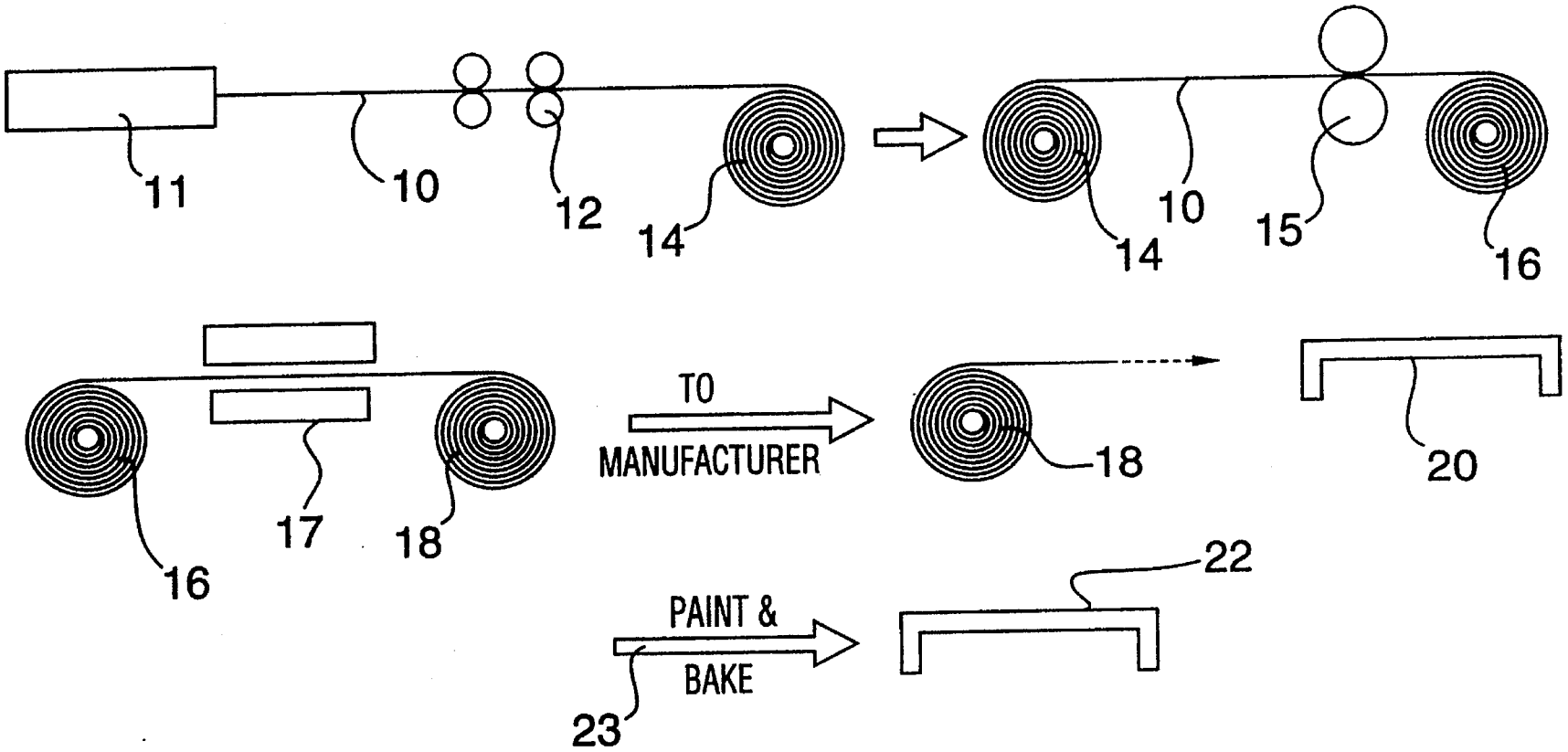
FIG. 5 is a schematic illustration of steps carried out according to a preferred embodiment of a process according to the invention.

An overall preferred process according to the present invention is shown in simplified schematic form in FIG. 5. Continuous metal strip 10, having a composition as defined in FIG. 1, is cast in twin belt caster 11 with a rate of heat extraction falling within the shaded band of FIG. 3 and subjected to hot rolling at rolling station 12. During this rolling step, some precipitates form. The hot rolled product is coiled to form coil 14. The hot rolled strip 10 is then unwound from coil 14, subjected to cold rolling in cold roll mill 15 and coiled to form coil 16. The cold rolled strip 10 is then unwound from coil 16 and subjected to a continuous solution heat treatment and controlled quenching, according to one of the three preferred cooling schemes referred to above, at station 17 to resolutionize and precipitate and constituent particles, and is then coiled to form coil 18. After natural aging for at least 48 hours, the coiled strip 18 is in T4 temper and, following normal levelling or flattening operations (not shown), may be sold to an automobile manufacturer who forms panels 20 from the strip by deformation and then paints and bakes the panels 23 to form painted panels 22 in T8X temper.

The present invention is further illustrated, without limitation, by the following Examples.

EXAMPLE 1

A total of 9 alloys were prepared using a pilot scale belt caster. The casting composition of these alloys is indicated in Table 2, below:

TABLE 2

| | Composition (Wt %) | | | | |
|---|---|---|---|---|---|
| Alloy # | Cu | Mg | Si | Mn | Fe |
| 1 | 0.75 | 0.78 | 0.68 | 0.16 | 0.27 |
| 2 | 0.30 | 0.50 | 0.70 | 0.05 | 0.22 |
| 3 | <0.01 | 0.81 | 0.89 | 0.03 | 0.27 |
| 4 | <0.01 | 0.46 | 0.71 | 0.03 | 0.25 |
| 5 | <0.01 | 0.61 | 1.20 | 0.001 | 0.18 |
| 6 | 0.37 | 0.61 | 1.19 | — | 0.18 |
| 7 | 0.61 | 0.79 | 1.38 | — | 0.18 |
| 8 | 1.03 | 0.99 | 0.29 | — | 0.20 |
| 9 | 0.38 | 1.31 | 0.38 | 0.16 | 0.18 |

Alloys #1 and #3 had compositions similar to alloys for automotive sheet which have been conventionally DC cast, scalped homogenized and which, after rolling, have been subjected to conventional heat treatment and quenching. Alloy #1 was similar to AA6111, except for a higher Fe level. Alloy #3 was of similar composition to an alloy which has been produced by DC casting and formed into sheet subsequently used in automotive applications, but has no registered composition.

Alloys #1, #2, #4, #8 and #9 had compositions lying in the range INAFEM of FIG. 2. Alloys #2 and #4 further had compositions lying in the range IJKL of FIG. 4, and Alloys #2 and #4 had Mg+Si+Cu of 1.5% and 1.2% respectively. Alloys #3 and #5 had compositions within the broad range of this invention, but outside the range INAFEM of FIG. 2. Alloy #7 was selected to have a composition outside the broad range of composition of this invention.

All the alloys were successfully cast on a pilot scale belt caster. The as-cast slabs were cast at a 25.4 mm gauge, 380 mm wide, at about 4 m/min on copper belts. The cast slabs were reheated to 500° C. and then hot rolled to 5 mm, and then cold rolled to 2.0 and 1.2 mm on a laboratory mill. The sheet was then given a simulated continuous annealing heat treatment consisting of rapid heating the material in the range 560° to 570° C., followed by a forced air quench, which simulated the conventional heat treatment given alloys of this type. After four days of natural aging (to meet the property stability requirement of T4 temper) the tensile properties were determined and some samples were given a simulated paint bake involving a 2% stretch followed by 30 minutes at 177° C. (T8X temper) prior to tensile testing.

The average mechanical properties of the samples are summarized in Table 3 along with properties of DC cast material for Alloys #1 (AA6111) and #3. These samples were taken after the aging normally required for stabilization of properties for this type of alloys, but prior to the flattening or levelling operation that is part of the commercial production process. Such operations can cause an increase of from 5 to 10 MPa in the T4 properties.

TABLE 3

| Alloy Designation | Gauge (mm) | Direction | Casting Route | T4 YS (MPa) | T4 UTS (MPa) | T4 % El | T8X YS (MPa) | T8X UTS (MPa) | T8X % El | ▷YS (T8X-T4) MPa |
|---|---|---|---|---|---|---|---|---|---|---|
| 1 | 1.2 | | Continuous | 136.0 | 279.0 | 24.3 | 214.0 | 300.0 | 21.5 | 78.0 |
| | 0.8 | | DC | 137.9 | 280.6 | 24.5 | 215.8 | 304.7 | 23.5 | 77.9 |
| 2 | 1.2 | L | Continuous | 113.0 | 234.0 | 26.0 | 164.0 | 245.0 | 22.6 | 51.0 |
| | | T | " | 110.0 | 233.0 | 24.0 | 164.0 | 245.0 | 20.0 | 54.0 |
| | 2.0 | L | " | 110.0 | 232.6 | 26.4 | — | — | — | — |
| | | T | " | 109.8 | 234.5 | 27.0 | — | — | — | — |
| 3 | 1.2 | L | Continuous | 136.0 | 260.6 | 25.9 | 200.0 | 279.0 | 22.5 | 64.0 |
| | | T | " | 133.0 | 268.0 | 24.0 | 200.0 | 277.0 | 23.0 | 67.0 |
| | 2.0 | L | " | 134.0 | 263.0 | 25.7 | — | — | — | — |
| | | T | " | 130.5 | 256.0 | 23.4 | — | — | — | — |
| | | | DC | 152.0 | 268.0 | 22.5 | 203.0 | 280.0 | 20.0 | 51.0 |
| 4 | 1.2 | L | Continuous | 91.0 | 201.7 | 29.3 | 139.4 | 215.1 | 23.2 | 48.4 |
| | | T | " | 89.9 | 201.6 | 29.2 | 132.4 | 211.5 | 22.3 | 42.5 |
| | 2.0 | L | " | 91.4 | 205.1 | 29.8 | — | — | — | — |
| | | T | " | 88.9 | 201.4 | 29.2 | — | — | — | — |
| 5 | 1.0 | L | " | 140.0 | 267.0 | 26.5 | 219.8 | 294.7 | 21.0 | 79.8 |
| | | T | " | 134.0 | 265.7 | 27.0 | 212.3 | 289.9 | 20.3 | 78.3 |
| 6 | 1.0 | L | " | 152.2 | 286.6 | 27.4 | 235.5 | 310.8 | 20.8 | 83.3 |
| | | T | " | 148.8 | 287.8 | 29.3 | 236.8 | 315.1 | 21.2 | 88.0 |
| 7 | 1.0 | L | " | 186.3 | 317.0 | 25.0 | 296.6 | 354.3 | 14.9 | 110.3 |
| | | T | " | 179.7 | 317.2 | 24.2 | 287.5 | 352.5 | 14.5 | 107.8 |
| 8 | 1.0 | L | " | 101.5 | 241.8 | 27.0 | 170.4 | 265.3 | 21.1 | 68.9 |
| | | T | " | 100.0 | 243.0 | 28.1 | 172.3 | 268.9 | 21.4 | 72.3 |
| 9 | 1.0 | L | " | 124.2 | 260.4 | 25.4 | 180.9 | 273.1 | 24.2 | 56.7 |
| | | T | " | 121.4 | 265.7 | 25.9 | 178.6 | 270.1 | 19.5 | 57.2 |

Alloy #1 gave very comparable results to AA6111 material that had been DC cast scalped and homogenized before rolling. Alloy #3 in T4 had slightly lower yield strength and slightly higher elongation than its DC counterpart, while in T8X the properties were comparable.

the heat treatment of this invention and consisting of a solution heat treatment as before for 5 minutes, followed by a forced air quench and immediately followed by a five hour preage at 85° C. Tensile properties under T4 and T8X tempers were measured and are compared to the properties achieved using the conventional heat treatment in Table 4.

TABLE 4

| Alloy # | Dir. | Conventional Solution Heat Treatment T4 YS (MPa) | T4 UTS (MPa) | T4 % El | T8X YS (MPa) | T8X UTS (MPa) | T8X % El | Control Quench Processing T4 YS (MPa) | T4 UTS (MPa) | T4 % El | T8X YS (MPa) | T8X UTS (MPa) | T8X % El |
|---|---|---|---|---|---|---|---|---|---|---|---|---|---|
| 2 | L | 113.0 | 234.0 | 26.0 | 164.0 | 245.0 | 22.6 | 90.6 | 212.0 | 29.0 | 240.0 | 299.0 | 16.3 |
| | T | 110.0 | 233.0 | 24.0 | 164.0 | 245.0 | 20.0 | — | — | — | — | — | — |
| 5 | L | 140.0 | 267.0 | 26.5 | 219.8 | 294.7 | 21.0 | 147.3 | 270.2 | 25.8 | 269.7 | 330.1 | 16.5 |
| | T | 134.0 | 265.7 | 27.0 | 282.3 | 289.9 | 20.3 | 136.0 | 262.2 | 24.9 | 262.8 | 325.8 | 15.9 |
| 6 | L | 152.2 | 286.6 | 27.4 | 235.5 | 310.8 | 20.8 | 151.2 | 281.9 | 26.9 | 274.2 | 337.2 | 17.3 |
| | T | 148.8 | 287.8 | 29.3 | 236.8 | 315.1 | 21.2 | 147.6 | 282.6 | 26.0 | 268.4 | 336.8 | 15.0 |
| 7 | L | 186.3 | 317.0 | 25.0 | 296.6 | 354.3 | 14.9 | 194.7 | 318.0 | 22.3 | 318.3 | 368.0 | 10.5 |
| | T | 179.7 | 317.2 | 24.2 | 287.5 | 352.5 | 14.5 | 190.0 | 318.0 | 22.5 | 310.9 | 368.0 | 10.4 |
| 8 | L | 101.5 | 241.8 | 27.0 | 170.4 | 265.3 | 21.1 | 104.2 | 243.4 | 27.0 | 199.0 | 288.0 | 22.3 |
| | T | 100.0 | 243.6 | 28.6 | 172.3 | 268.9 | 21.4 | 102.7 | 243.9 | 25.0 | 194.7 | 289.0 | 20.2 |
| 9 | L | 124.2 | 260.4 | 25.4 | 180.9 | 273.1 | 24.2 | 114.4 | 249.9 | 28.7 | 222.0 | 305.0 | 19.5 |
| | T | 121.4 | 255.7 | 25.9 | 178.6 | 270.1 | 19.5 | 110.8 | 246.9 | 25.4 | 214.6 | 298.8 | 17.5 |

Belt cast alloys #1, #3, #5, #6, #8 and #9 all had T4 and T8X yield strengths within the desired ranges of 90 to 175 MPa and >170 MPa respectively and would also fall within these ranges if allowance is made for the increase in tensile strength following normal levelling or flattening operations. Alloys #2 and #4, lying in the range IJKLM of FIG. 4 had yield strengths under T8X which were less than the desired 170 MPa. Alloy #7 had a yield strength under T4 which was too high to permit easy formability.

Samples of all alloys except alloys #1, #3 and #4 were also subject to a simulated heat treatment corresponding to All alloys listed, with the exception of Alloy #7, have T4 and T8X properties lying within the desired range. Alloy #7 still has T4 yield strengths which are too high for the end use, particularly if the increase for flattening or levelling noted above is added to the measured values.

EXAMPLE 2

Two alloys were cast on an industrial belt caster. The slab was cast at 19 mm gauge and hot rolled to 5 mm gauge. The material was then processed in the laboratory in the same manner as indicated in Example 1. The composition of the alloys is listed in Table 5.

TABLE 5

| | Composition (Wt %) | | | | |
|---|---|---|---|---|---|
| Alloy # | Cu | Mg | Si | Mn | Fe |
| 10 | 0.01 | 0.65 | 0.84 | 0.05 | 0.23 |
| 11 | 0.29 | 0.52 | 0.68 | 0.07 | 0.21 |

After four days natural age the sheet was tensile tested to obtain the T4 properties, as well given a paint bake simulation —a 2% stretch followed by 30 minutes at 177° C. to obtain T8X properties.

The mechanical properties in T4 and T8X tempers are listed in Table 6 and produced using the normal cooling process following solution heat treatment, which includes the data of alloys 2 and 4 of Example 1 for comparison. It should be noted that the Alloy #10 is a modified version of Alloy #4 of Example 1. Alloy #11 is equivalent to the Alloy #2 of Example 1. It can be seen that yield strength of the commercially cast Alloy #10 is higher than Alloy #4, which is expected because of the higher amounts of Mg and Si levels. The Alloy #11 has properties very similar to that of the Alloy #2 mentioned in Example 1. In all cases, the paint bake response in T8X temper is quite comparable.

The alloys were also processed using the simulated controlled quench process as in Example 1. Table 7 compares tensile properties arising following the simulated conventional and simulated controlled quench process on this invention and demonstrates that the T8X properties can be increased to target levels by the process on this invention. The T4 yield strengths are also reduced, but as noted in Example 1, when consideration is made of the normally higher values obtained following commercial processes of tensile levelling for example they still fall within the desired range of properties, and both T4 and T8X properties are consistent with the results of Example 1.

EXAMPLE 3

Alloys #10 and #11 of Example 2 were also processed, following belt casting and hot rolling, on a commercial cold mill and continuous heat treatment line. The heat treatment line used the solution heat treatment and controlled quench process of this invention, specifically using four temperature steps during cooling with a coiling step prior to the final cooling step. The coils underwent the normal ageing of at least 48 hours. Samples were taken for testing, however, prior to any flattening or levelling operation.

The tensile properties of the samples are given in Table 8. The tensile properties differ slightly from the properties for simulated controlled quench material from Example 2, because the simulation does not exactly duplicate the commercial process. However the tensile properties under T4 and T8X fall within the requirements of invention.

TABLE 8

| | | T4 | | | T8X | | |
|---|---|---|---|---|---|---|---|
| Alloy # | Dir. | YS (MPa) | UTS (MPa) | % El | YS (MPa) | UTS (MPa) | % El |
| 10 | L | 112.0 | 213.4 | 19.9 | — | — | — |
| | T | 107.5 | 210.2 | 21.8 | 234.8 | 288.0 | 14.2 |
| 11 | L | 103.5 | 209.2 | 21.9 | — | — | — |
| | T | 99.9 | 210.7 | 27.5 | 221.7 | 281.4 | 16.4 |

What we claim is:

1. A process of producing a sheet of an alloy of aluminum containing magnesium, silicon, optionally copper, and optionally manganese in amounts in percent by weight falling within a range selected from the group consisting of:

(1) $0.4 \leqq Mg \leqq 0.8$, 02≦Si 0.5, $0.3 \leqq Cu \leqq 3.5$, $Mn \leqq 0.4$;

(2) $0.8 \leqq Mg \leqq 1.4$, $0.2 \leqq Si \leqq 0.5$, $Cu \leqq 2.5$, $Mn \leqq 0.4$; and (3) $0.4 \leqq Mg \leqq 1.0$, $0.2 \leqq Si \leqq 1.4$, $Cu \leqq 2.0$, $Mn \leqq 0.4$ wherein process comprises forming a cast sheet by subjecting the alloy to a twin belt casting process at a heat

TABLE 6

| | | | T4 | | | T8X | | | ▷YS |
|---|---|---|---|---|---|---|---|---|---|
| Alloy Designation | Direction | Continuous Casting | YS (MPa) | UTS (MPa) | % El | YS (MPa) | UTS (MPa) | % El | (T8X-T4) MPa |
| 4 | L | Pilot | 91.0 | 201.7 | 29.3 | 139.4 | 215.1 | 23.2 | 48.0 |
| 10 | L | Industrial | 128.5 | 247.6 | 27.0 | 176.3 | 258.5 | 24.3 | 47.8 |
| 2 | L | Pilot | 113.0 | 234.0 | 26.0 | 164.0 | 245.0 | 22.6 | 51.0 |
| 11 | L | Industrial | 109.0 | 225.5 | 27.0 | 158.0 | 241.0 | 22.9 | 49.0 |

TABLE 7

| | | Conventional Solution Heat Treatment | | | | | | Control Quench Processing | | | | | |
|---|---|---|---|---|---|---|---|---|---|---|---|---|---|
| | | T4 | | | T8X | | | T4 | | | T8X | | |
| Alloy # | Dir | YS (MPa) | UTS (MPa) | % El | YS (MPa) | UTS (MPa) | % El | YS (MPa) | UTS (MPa) | % El | YS (MPa) | UTS (MPa) | % El |
| 10 | L | 128.5 | 247.6 | 27.0 | 176.3 | 258.5 | 24.3 | 111.6 | 233.0 | 26.0 | 253.0 | 309.0 | 18.4 |
| | T | 126.5 | 248.3 | 27.0 | 176.5 | 260.7 | 25.2 | 111.0 | 234.0 | 27.0 | 250.0 | 310.0 | 18.0 |
| 11 | L | 109.0 | 225.5 | 27.0 | 158.0 | 241.0 | 22.9 | 89.0 | 205.0 | 29.5 | 231.5 | 292.0 | 17.0 |
| | T | 108.0 | 228.6 | 26.0 | 164.0 | 245.0 | 20.0 | 85.0 | 207.0 | 26.6 | 230.0 | 292.6 | 16.0 |

extraction rate within the range defined by the following equations:

Lower bound heat flux ($MW/m^2$)=2.25+0.0183$\Delta t_f$

Upper bound heat flux ($MW/M^2$)=2.86+0.02222$\Delta t_f$

Lower bound of alloy freezing range=30° C.

Upper bound of alloy freezing range=90° C.

wherein $\Delta T_f$ is given in degree Celsius, followed by subjecting the cast sheet to hot and cold rolling.

2. Process according to claim 1 wherein said alloy has a T4 temper strength in the range 90–175 MPa and a potential T8X temper strength of at least 170 MPa.

3. Process according to claim 2 wherein said a sheet heat treated by a heat treatment selected from (a) solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, and then cooling to ambient temperature at a rate of less than about 10° C./hour, (b) solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, coiling said sheet and then cooling to ambient temperature at a rate of less than about 10° C./hour, and (c) solution heat treating said sheet at a temperature in the range of 500° to 570° C. and then forced cooling said sheet using a means of cooling selected from water, water mist or forced air, and coiling said sheet at a temperature of between 50° and 100° C., then allowing said coil to cool at a rate of less than about 10° C./hour.

4. Process according to claim 1 in which a maximum amount of copper, relative to specific amounts of silicon and magnesium, is as shown in area ABCDEF in FIG. 1 of the accompanying drawings.

5. Process according to claim 1 wherein said alloy comprises at least one additional element selected from the group consisting of Fe in an amount of 0.4 percent by weight or less, Zn in an amount of 0.3 percent by weight or less and a small amount of at least one other element.

6. Process according to claim 5 wherein said at least one other element is selected from the group consisting of Cr, Ti, Zr and V, the total amount of Cr+Ti+Zr+V not exceeding 0.3 percent by weight of the alloy.

7. An aluminum alloy sheet containing amounts of Mg, Si and Cu falling within area INAFEM of FIG. 2 of the accompanying drawings contained within the following equations:

Mg=0.4% (Line *IM*)

Mg=1.375% −0.75×%Si (Line *EM*)

Si=0.5% (Line *EF*)

Mg=1.4% (Line *AF*)

Si=0.2% (Line *AN*)

Mg=1.567% −2.333×%Si (Line *IN*)

and has Cu≦2.5% said sheet having been heat treated to have a T4 temper strength, after cold rolling, solution heat treating, cooling to room temperature, natural aging and levelling or flattening, in the range 90–175 MPa and a potential T8X temper strength of at least 170 MPa when Simulated by deformation in tension by 2% followed by heat treatment selected from the group consisting of heat treatment at 170° C. for 20 minutes or 177° C. for 30 minutes;

said sheet having been heat treated by a treatment selected from (a) solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, and then cooling to ambient temperature at a rate of less than about 10° C./hour, (b) solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, coiling said sheet and then cooling to ambient temperature at a rate of less than about 10° C./hour, and (c) solution heat treating said sheet at a temperature in the range of 500° to 570° C. and then forced cooling said sheet using a means of cooling selected from water, water mist or forced air, and coiling said sheet at a temperature of between 50° and 100° C., then allowing said coil to cool at a rate of less than about 10° C./hour.

8. An aluminum alloy sheet containing amounts of Mg, Si and Cu falling within area IJKLM of FIG. 4 of the accompanying drawings contained within the following equations:

Si=0.5% (Line *IJ*)

Mg=0.8% (Line *JK*)

Mg=1.4% −%Si (Line *KL*)

Si=0.8% (Line *LM*)

Mg=0.4% (Line *IM*)

and has Cu≦2.5% said sheet having been treated to have a T4 temper strength, after cold rolling, solution heat treating, cooling to room temperature, natural aging and levelling or flattening, in the range 90–175 MPa and a potential T8X temper strength of at least 170 MPa when simulated by deformation in tension by 2% followed by a heat treatment selected from the group consisting of heat treatment at 170° C. for 20 minutes or 177° C. for 30 minutes;

said sheet having been heat treated by a treatment selected from (a) solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, and then cooling to ambient temperature at a rate of less than about 10° C./hour, (b) solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, coiling said sheet and then cooling to ambient temperature at a rate of less than about 10° C./hour, and (c) solution heat treating said sheet at a temperature in the range of 500° to 570° C. and then forced cooling said sheet using a means of cooling selected from water, water mist or forced air, and coiling said sheet at a temperature of between 50° and 100° C., then allowing said coil to cool at a rate of less than about 10° C./hour.

9. A process of preparing aluminum alloy sheet material suitable in particular for automotive applications, comprising;

in a belt casting machine, producing alloy slab by casting an alloy of aluminum containing magnesium, silicon, optionally copper, and optionally manganese, in amounts in percent by weight falling a range selected from the group consisting of;

(1) $0.4 \leqq Mg \leqq 0.8$, $0.2 \leqq Si \leqq 0.5$, $0.3 \leqq Cu \leqq 3.5$, $Mn \leqq 0.4$ (2) $0.8 \leqq Mg \leqq 1.4$, $0.2 \leqq Si \leqq 0.5$, $Cu \leqq 2.5$, $Mn \leqq 0.4$, and (3) $0.4 \leqq Mg \leqq 1.0$, $0.2 \leqq Si \leqq 1.4$, $Cu \leqq 2.0$, $Mn \leqq 0.4$ while extracting heat from said alloy at a rate, falling within a shaded band defined in FIG. 3 of the accompanying drawings corresponding to a freezing range of said alloy, that avoids both shell distortion of said sheet and excessive surface segregation, at least until said alloy freezes;

hot rolling and cold rolling said slab to form a sheet;

solution heat treating said sheet to re-dissolve precipitated particles; and cooling said sheet at a rate that produces a T4 temper and a potential T8X temper suitable for automotive applications.

10. A process according to claim 9 wherein said aluminum alloy has contents of Mg, Si and optionally Cu falling within area INAFEM defined in FIG. 2 of the accompanying drawings.

11. A process according to claim 9 wherein said alloy is solution heat treated at a temperature in the range of 500° to 570° C. and is then cooled to between 350° C. and 220° C. at a rate greater than about 10° C./sec but not more than about 2000° C./sec, then cooled to a temperature in the range of 270° C. and 140° C. at a rate greater than 1° C./sec but not faster than 50° C./sec, then cooled to between 120° C. and 50° C. at a rate greater than 5° C./min, but less than 20° C./sec, and then cooled to ambient temperature at a rate of less than about 10° C./hour.

12. A process according to claim 11 wherein said alloy is in sheet form and is coiled after being cooled to between 120° C. and 50° C. but before being cooled to ambient temperature.

13. A process according to claim 9 wherein said alloy is in the form of a sheet and the sheet is force cooled by a method selected from the group consisting of water cooling, water mist cooling and forced air cooling, and is then coiled at a temperature of 50° to 100° C., and allowed to cool at a rate of less than about 10° C./hour.

14. A process according to claim 13 wherein said sheet is force cooled to a temperature of between 120° to 150° C.

15. A process according to claim 13 wherein said sheet is coiled at a temperature of at least 85° C.

16. A process according to claim 11 wherein said alloy contains a total amount of Mg+Si+Cu of 1.4 wt. % or less.

17. A process according to claim 11 wherein said alloy has a composition falling within the area IJKLM of FIG. 4 of the accompanying drawings contained within the following equations:

$Si=0.5\%$ (Line *IJ*)

$Mg=0.8\%$ (Line *JK*)

$Mg=1.4\% - \%Si$ (Line *KL*)

$Si=0.8\%$ (Line *LM*)

$Mg=0.4$ (Line *IM*), the Cu content being $\leqq 2.5\%$.

18. A process according to claim 9 wherein said sheet is subjected to hot rolling and cold rolling to a final desired gauge thickness prior to said solution heat treatment.

19. A process of imparting T4 and T8X temper suitable for automotive applications to a sheet of an aluminum alloy, comprising:

solution heat treating said sheet at a temperature in the range of 500° to 570° C. and then cooling said sheet to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, and then cooling to ambient temperature at a rate of less than about 10° C./hour;

wherein said aluminum alloy contains magnesium, silicon and optionally copper in amounts in percent by weight falling within a range selected from the group consisting of:

(1) $0.4 \leqq Mg \leqq 0.8$, $0.2 \leqq Si \leqq 0.5$, $0.3 \leqq Cu \leqq 3.5$;

(2) $0.8 \leqq Mg \leqq 1.4$, $0.2 \leqq Si \leqq 0.5$, $Cu \leqq 2.5$; and (3) $0.4 \leqq Mg \leqq 1.0$, $0.2 \leqq Si \leqq 1.4$, $Cu \leqq 2.0$.

20. A process according to claim 19 wherein said alloy is in sheet form and is coiled after being cooled to between 120° C. and 50° C. but before being cooled to ambient temperature.

21. A process of imparting T4 and T8X temper suitable for automotive panels to a sheet of an aluminum alloy, comprising:

solution heat treating said sheet at a temperature in the range of 500° to 570° C. and then force cooling said sheet by a method selected from the group consisting of water cooling, water mist cooling and forced air cooling, and coiling the sheet at a temperature of 50° to 100° C., and then allowing the sheet to cool at a rate of less than about 10° C./hour;

wherein said aluminum alloy contains magnesium, silicon and optionally copper in amounts in percent by weight falling within a range selected from the group consisting of:

(1) 0.4≦Mg≦0.8, 0.2≦Si≦0.5, 0.3≦Cu≦3.5;

(2) 0.8≦Mg≦1.4, 0.2≦Si≦0.5, Cu≦2.5; and (3) 0.4≦Mg≦1.0, 0.2≦Si≦1.4, Cu≦2.0.

22. A process according to claim 21 wherein said sheet is force cooled to a temperature of between 120° to 150° C.

23. A process according to claim 21 wherein said sheet is coiled at a temperature of at least 85° C.

24. A process according to claim 19 wherein said aluminum alloy comprises at least one additional element selected from the group consisting of Fe in an amount of 0.4 percent by weight or less, Mn in an amount of 0.4 percent by weight or less, and a small amount of at least one other element.

25. A process according to claim 24 wherein said at least one other element is selected from the group consisting of Cr, Ti, Zr and V, the total amount of Cr+Ti+Zr+V not exceeding 0.15 percent by weight of the alloy.

26. A process according to claim 19 wherein said aluminum alloy contains amounts of Mg, Si and Cu falling within a volume INAFEM of FIG. 2 of the accompanying drawings.

27. Aluminum alloy sheet material produced by a process comprising:

in a belt casting machine, producing alloy sheet by casting an alloy of aluminum containing magnesium, silicon optionally copper, and optionally manganes in amounts in percent by weight falling with a range selected from the group consisting of:

(1) 0.4≦Mg≦0.8, 0.2≦Si≦0.5, 0.3≦Cu≦3.5, Mn≦0.4

(2) 0.8≦Mg≦1.4, 0.2≦Si≦0.5Cu≦2.5, Mn≦0.4, and (3) 0.4≦Mg≦1.0, 0.2≦Si≦1.4, Cu≦2.0, Mn≦0.4 while extracting heat from said alloy at a rate, falling within a shaded band defined in FIG. 3 of the accompanying drawings corresponding to a freezing range of said alloy, that avoids both shell distortion of said sheet and excessive surface segregation, at least until said alloy freezes;

solution heat treating said sheet to re-dissolve precipitated particles; and cooling said sheet at a rate that produces a T4 temper and a potential T8X temperature suitable for automotive panels.

28. An alloy of aluminum containing magnesium silicon and optionally copper in amounts in percent by weight falling within a range selected from the group consisting of:

(1) 0.4≦Mg≦0.8, 0.2≦Si≦0.5, 0.3≦Cu≦3.5;

(2) 0.8≦Mg≦1.4, 0.2≦Si≦0.5, Cu≦2.5; and (3) 0.4≦Mg≦1.0, 0.2≦Si≦1.4, Cu≦2.0 wherein the alloy has a T4 temper strength in the range 90–175 MPa and a potential T8X temper strength of at least 170 MPa and has been produced in the form of a sheet by a twin belt casting process and a hot and cold rolling process, said twin belt casting process having been carried out with a heat extraction rate within the range defined by the following equations:

$$\text{Lower bound heat flux } (MW/m^2)=2.25+0.0183\Delta T_f$$

$$\text{Upper bound heat flux } (MW/m^2)=2.8+0.0222\Delta T_f$$

$$\text{Lower bound of alloy freezing range}=360^\circ \text{ C.}$$

$$\text{Upper bound of alloy freezing range}=90^\circ \text{ C.}$$

where $\Delta T_f$ is given in degree Celsius;

said alloy being in the form of a sheet which has been heat treated by a heat treatment selected from the group consisting of (a) solution heat treating said sheet at a temperature in the range of 500° to 570° C. and then cooling said sheet according to a scheme comprising cooling to between 350° C. and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, and then cooling to ambient temperature at a rate of less than about 10° C./hour, (b) solution heat treating said sheet at a temperature in the range of 500° to 570° C. and then cooling said sheet according to a scheme comprising cooling to between 350° C., and 220° C. at a rate greater than about 10° C./sec but not more than about 2000° C./sec, then cooling to a temperature in the range of 270° C. and 140° C. at a rate greater than 1° C./sec but not faster than 50° C./sec, then cooling to between 120° C. and 50° C. at a rate greater than 5° C./min, but less than 20° C./sec, coiling said sheet and then cooling to ambient temperature at a rate of less than about 10° C./hour, and (c) solution heat treating said sheet at a temperature in the range of 500° to 570° C. and then forced cooling said sheet using a means of cooling selected from water, water mist or forced air, and coiling said sheet at a temperature of between 50° and 100° C., then allowing said coil to cool at a rate of less than about 10° C./hour.

29. A process of preparing aluminum alloy sheet material suitable in particular for automotive applications comprising:

in a belt casting machine, producing alloy slab by casting an alloy of aluminum containing magnesium, silicon and optionally copper in amounts in percent by weight falling within a range selected from the group consisting of:

(1) 0.4≦Mg≦0.8, 0.2≦Si≦0.5, 0.3≦cu≦3.5

(2) 0.8≦Mg≦1.4, 0.2≦Si≦0.5, Cu≦2.5, and (3) 0.4≦Mg≦1.0, 0.2≦Si≦1.4, Cu≦2.0 while extracting heat from said alloy at a rate, falling within a shaded band defined in FIG. 3 of the accompanying drawings corresponding to a freezing range of said alloy, that avoids both shell distortion of said sheet and excessive surface segregation, at least until said alloy freezes;

hot rolling and cold rolling said slab to form a sheet;

solution heat treating said sheet to re-dissolve precipitated particles; and cooling said sheet at a rate that produces a T4 temper and a potential T8X temper suitable for automotive applications;

said sheet having been subjected to a treatment selected from the group of consisting of;

(a) solution heat treating said sheet at a temperature in the range of 500° to 570° C. and then cooling said sheet according to a scheme comprising cooling to between 350° C. and 220° at a rate greater than about 10° C./sec but not more than about 2000° C./sec, then cooling to a temperature in the range of 270° C. and 140° C. at a rate greater than 1° C./sec. but not faster than 50° C./sec. then cooling to between 120° C. and 50° C. at a rate greater than 5° C./min, but less than 20° C./sec, and then cooling to ambient temperature at a rate of less than about 10° C./hour, (b) solution heat treating said sheet at a temperature in the range of 500° to 570° C. and then cooling said sheet according to a scheme comprising cooling to between 350° C. and 220° C. at a rate greater than about 10° c./sec but not more than about 2000° C./sec, then cooling to a temperature in the range of 270° C. and 140° C. at a rate greater than 1° C./sec but not faster than 50° C./sec, then cooling to between 120° C. and 50° C. and 50° C. at a rate greater than 5° C./min, but less than 20° C./sec, cooling said sheet and then cooling to ambient temperature at a rate of less than about 10° C./hour, and (c) solution heat treating said sheet at a temperature in the range of 500° to 570° C. and then forced cooling said sheet using a means of cooling selected from water, water mist or forced air, and cooling said sheet at a temperature of between 50° and 100° C. then allowing said coil to cool at a rate of less than about 10° C./hour.

* * * * *